US005630901A

United States Patent [19]

Yamamoto et al.

[11] Patent Number: 5,630,901

[45] Date of Patent: May 20, 1997

[54] METHOD AND JIG FOR HOLDING CONTACT LENS MATERIAL, USING LIGHT-SCATTERING BONDING ADHESIVE

[75] Inventors: Yasuyoshi Yamamoto, Komaki; Atsuhiro Doke, Kasugai; Hiroyuki Ohyama; Seiichi Ichikawa, both of Kakamigahara; Keiji Yamashita, Nagoya, all of Japan

[73] Assignee: Menicon Co., Ltd., Japan

[21] Appl. No.: 361,496

[22] Filed: Dec. 22, 1994

[30] Foreign Application Priority Data

Dec. 28, 1993 [JP] Japan ..... 5-337354

[51] Int. Cl.[6] ..... B32B 31/00

[52] U.S. Cl. ..... 156/275.7; 351/160 R

[58] Field of Search ..... 451/42, 390, 384; 351/160 R; 33/28; 65/37; 156/272.2, 275.5, 275.7

[56] References Cited

U.S. PATENT DOCUMENTS

| | | | |
|---|---|---|---|
| 4,432,832 | 2/1984 | Fantone | 156/344 |
| 4,776,923 | 10/1988 | Spencer et al. | 156/643 |
| 5,007,975 | 4/1991 | Yamamoto et al. | 156/154 |
| 5,009,731 | 4/1991 | Yoshikawa et al. | 451/42 X |
| 5,200,010 | 4/1993 | Funami et al. | 156/299 X |
| 5,380,387 | 1/1995 | Salamon et al. | 156/289 X |
| 5,399,227 | 3/1995 | Abrams | 156/580 X |
| 5,433,810 | 7/1995 | Abrams | 156/580 X |

OTHER PUBLICATIONS

Patent Abstracts of Japan, vol. 9, No. 215 (M–409) Sep. 3, 1985 & JP–A– 60 073 836 (Touyou Kontakutorenzu KK) Apr. 26, 1985.

Patent Abstracts of Japan, vol. 18, No. 241 (P–1733) May 9, 1994 & JP–A–06 027 404 (Hitachi Ltd) Feb. 4, 1994.

*Primary Examiner*—David A. Simmons
*Assistant Examiner*—Paul M. Rivard
*Attorney, Agent, or Firm*—Parkhurst, Wendel & Burr, LLP

[57] ABSTRACT

A jig adapted to hold a contact lens material having a concave surface, for holding the contact lens material, including a protruding portion which has a top end having as an outer surface thereof a convex surface. This convex surface of the jig is bonded to the concave surface of the contact lens material. The protruding portion has a recess which extends from an inner surface of the top end toward a bottom end of the protruding portion. The recess is defined by an inner surface which includes a first portion that corresponds to the convex surface of the top end of the protruding portion. At least the first portion of the inner surface is toughened with a light-scattering texture. A method of holding the contact lens material while the contact lens material is processed into a contact lens is disclosed.

3 Claims, 2 Drawing Sheets

METHOD AND JIG FOR HOLDING CONTACT LENS MATERIAL, USING LIGHT-SCATTERING BONDING ADHESIVE

BACKGROUND OF THE INVENTION

1. Field of the Invention

The present invention generally relates to a jig which is adapted to be bonded to one of opposite surfaces of a contact lens material which has been machined, for holding the lens material while the other surface is machined. In particular, the invention is concerned with such a jig as described above, which is bonded to the contact lens material with high uniformity in bonding strength, thereby assuring enhanced accuracy with which the lens material is machined, and which permits accurate measurement of a front curve of a contact lens formed from the contact lens material while the material is bonded to the jig.

2. Discussion of Related Art

In a conventional method for producing a contact lens, a suitable lens material is fixed to a spindle which is rotatable about an axis, and one and the other of the opposite surfaces of the lens material are sequentially subjected to machining operations, such as cutting and grinding, and further to suitable treatments as needed. More specifically described, one of the opposite surfaces of the lens material, which gives a concave inner surface of the contact lens, is first subjected to the cutting and grinding operations and other treatments, and the other surface of the lens material, which gives a convex outer surface of the contact lens, is then subjected to similar machining operations and treatments, so that the opposite surfaces of the lens material respectively provide desirably shaped inner and outer surfaces of the contact lens.

In the above process of producing the contact lens, the above-indicated other surface of the lens material is machined while the above-indicated one surface, which has been machined to form the concave inner lens surface, is held by a suitable jig through which the lens material is attached to the spindle. Thus, the inner lens surface is protected during the machining operations on the other surface of the lens material.

The jig favorably used in the above process includes a protruding portion which has a top end having as its outer surface a convexedly curved surface that substantially follows the concave inner lens surface formed by machining the above-indicated one surface of the lens material. The jig is bonded at its convexedly curved, top end face to the concave lens surface so as to hold the lens material in position. In this case, an ultraviolet-curable (UV-curable) bonding agent or adhesive is particularly favorably used as a bonding agent for bonding the jig and the lens material together. The UV-curable bonding agent, which is interposed between the convex surface of the top end of the jig and the concave surface of the lens material, is irradiated from the outside with an ultraviolet radiation, and is thus cured. This permits the lens material to be freely removably bonded to the jig, without affecting the lens surface bonded to the jig, while suitably controlling the time when the curing of the bonding agent is initiated. Thus, the use of the above bonding agent ensures improved efficiency with which the contact lens material is machined.

In the conventional jig used as described above, a recess is formed on the rear side of the protruding portion opposite to the top end face (convexedly curved surface) to be bonded to the lens material, so that optical fibers are inserted into the recess which extends inwardly of the protruding portion, and the bonding agent is irradiated with ultraviolet radiation transmitted through the optical fibers. This arrangement meets a requirement for continuously processing the contact lens materials so as to form one contact lens after another. In this arrangement, however, a variation in the intensity of the ultraviolet radiation may arise at the top end face of the protruding portion which serves as the bonding surface, resulting in non-uniform or inconsistent curing of the bonding agent, and consequent variation in the bonding strength between the lens material and the jig. Consequently, the lens material may be distorted during a cutting operation, for example, resulting in reduced machining accuracy, or may even be removed from the jig in some cases.

In addition, the contact lens thus produced from the lens material is usually inspected in terms of its nominal specifications according to predetermined standards, by irradiating the convex outer surface of the lens, and detecting a light reflected by the convex outer surface so as to measure a radius of curvature, that is, a front curve of the outer lens surface. If this inspection is effected while the contact lens material is bonded to the jig, the light incident upon the outer lens surface may also be incident upon and reflected by the inner wall of the recess formed on the rear side of the jig, and the thus reflected light may cause a noise, which makes it difficult to measure the front curve of the lens surface with sufficiently high accuracy. Therefore, the above-described inspection for the contact lens is conventionally effected in a separate process step after the contact lens material which has been machined is removed from the jig, resulting in a considerable reduction in the production efficiency of the contact lenses.

SUMMARY OF THE INVENTION

It is a first object of the present invention to provide a method of holding a contact lens material with a jig and an ultraviolet-curable bonding agent, which method assures uniform bonding strength between the contact lens material and the jig over the entire area of the bonding surface of the contact lens material.

It is a second object of the present invention to provide a method of holding a contact lens material with a jig and an ultraviolet-curable bonding agent, which method permits accurate optical measurement of a radius of curvature of an outer surface of a contact lens produced from the contact lens material while the contact lens is bonded to the jig.

It is a third object of the present invention to provide a jig which can be suitably used to practice the method indicated above.

The first and second objects may be achieved according to a first aspect of the present invention, which provides a method of holding a contact lens material having a concave surface while the contact lens material is processed into a contact lens, comprising the steps of: (a) preparing a jig including a protruding portion which has a top end having as an outer surface thereof a convex surface, which is adapted to be bonded to the concave surface of the contact lens material, the protruding portion having a recess which extends from an inner surface of the top end opposite to the convex surface, toward a bottom end of the protruding portion, the recess being defined by an inner surface which includes a first portion that corresponds to the convex surface of the top end of the protruding portion, at least the first portion of the inner surface being roughened with a light-scattering texture; (b) applying an ultraviolet-curable bonding agent to at least one of the concave surface of the contact lens material and the convex surface of the protruding portion of the jig; (c) placing the contact lens material such that the concave surface of the contact lens material is in contact with the convex surface of the jig through the ultraviolet-curable bonding agent; and (d) irradiating at least the first portion of the inner surface of the recess with an ultraviolet radiation, to cure the ultraviolet-curable bonding agent and thereby bond the contact lens material and the jig together.

The above third object may be accomplished according to a second aspect of the present invention, which provides a jig adapted to hold a contact lens material having a concave surface, for holding the contact lens material, including a protruding portion which has a top end having as an outer surface thereof a convex surface, which is adapted to be bonded to the concave surface of the contact lens material, the protruding portion having a recess which extends from an inner surface of the top end opposite to the convex surface toward a bottom end of the protruding portion, the recess being defined by an inner surface which includes a first portion that corresponds to the convex surface of the top end of the protruding portion, at least the first portion of the inner surface being roughened with a light-scattering texture.

The method of the invention can be suitably practiced by using the jig constructed as described above. In the present jig, the recess is formed behind the protruding portion having the top end whose outer surface provides the convex curved surface to which the contact lens material is bonded. At least a portion of the inner surface defining the recess, which portion corresponds to the convex surface of the top end to be bonded to the lens material, is roughened or roughly textured so as to function like a ground glass, and is capable of effectively scattering a light incident upon the inner surface portion defining the recess. When the contact lens material is bonded to the convex surface of the protruding portion of the jig, a UV-curable adhesive is applied to the convex surface, and the adhesive is cured by exposure to an ultraviolet radiation. To this end, optical fibers are inserted into the recess, so as to irradiate the inner surface of the recess with an ultraviolet radiation transmitted therethrough. Therefore, the ultraviolet radiation is irregularly reflected by the roughened portion of the inner wall surface of the recess, and thus effectively scattered. This significantly reduces a variation in the light intensity which may otherwise occur at the convex surface or bonding surface of the top end of the protruding portion.

Accordingly, the present jig can be bonded to the contact lens material by means of an ultraviolet-curable bonding agent, with substantially uniform bonding strength over the entire area of the bonding surface of the jig. This effectively prevents the contact lens material from being distorted or removed from the jig while it is being machined, which may otherwise occur due to the variation of the bonding strength between the lens material and the jig, thereby assuring a significantly improved machining accuracy.

In the jig constructed above, the roughly textured portion of the inner wall surface of the recess opposite to the convex surface of the top end of the protruding portion has improved capability of scattering the light transmitted through the optical fibers inserted into the recess, as described above. This roughly textured portion of the inner wall surface of the recess is also able to effectively scatter a light which is transmitted through the outer convex surface of the contact lens produced from the lens material, and thus significantly reduce the amount of reflection of the light by the roughened portion back toward the contact lens. This is particularly advantageous when a light reflected by the outer surface of the contact lens is detected to measure a radius of curvature or front curve of the outer lens surface, for inspecting the produced contact lens, since accurate measurement of the front curve can be effected while the contact lens formed from the lens material is still bonded to the jig. Thus, the machining of the lens material and inspection of the formed contact lens can be effected in a single process step, assuring remarkably improved production efficiency of the contact lens.

BRIEF DESCRIPTION OF THE DRAWINGS

The above and optional objects, features and advantages of the present invention will be better understood by reading the following detailed description of a preferred embodiment of the invention, when considered in connection with the accompanying drawings, in which.

DETAILED DESCRIPTION OF THE PREFERRED EMBODIMENT

Figure 1:
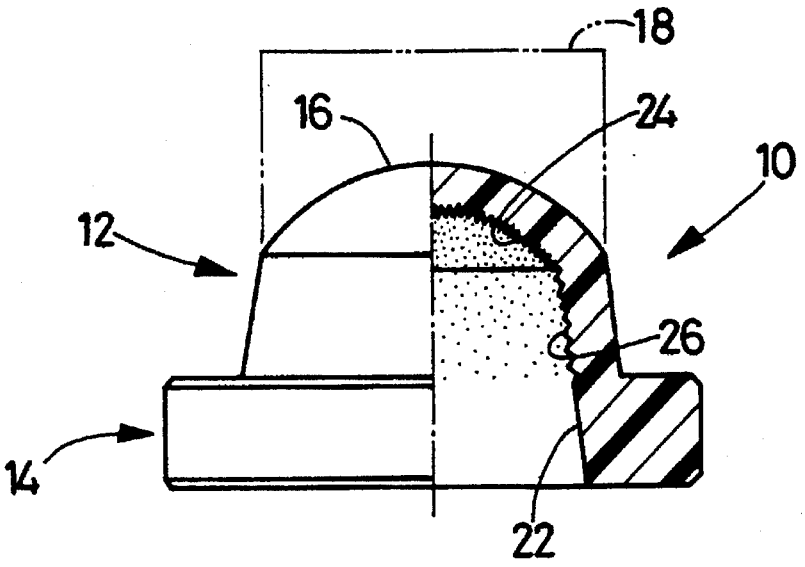
FIG. 1 is an elevational view partially in cross section showing one embodiment of a jig of the present invention.
Figure 2:
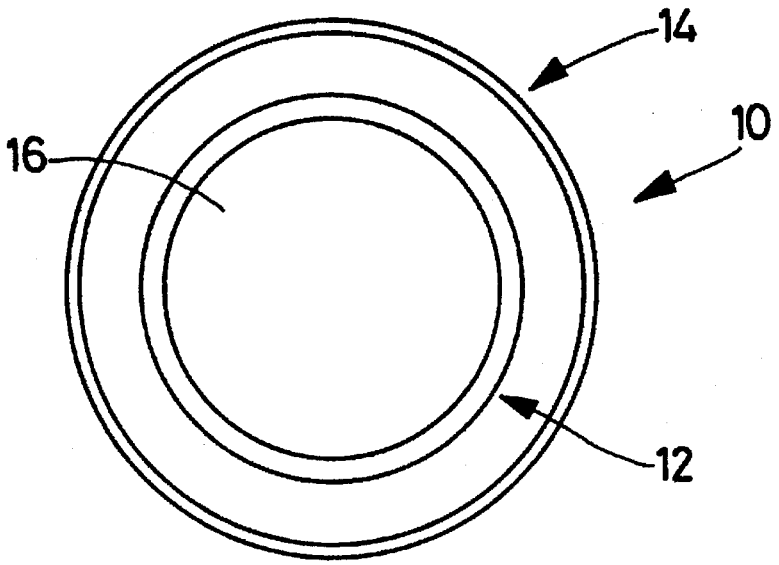
FIG. 2 is a plan view of the jig shown in FIG. 1.
Figure 3:
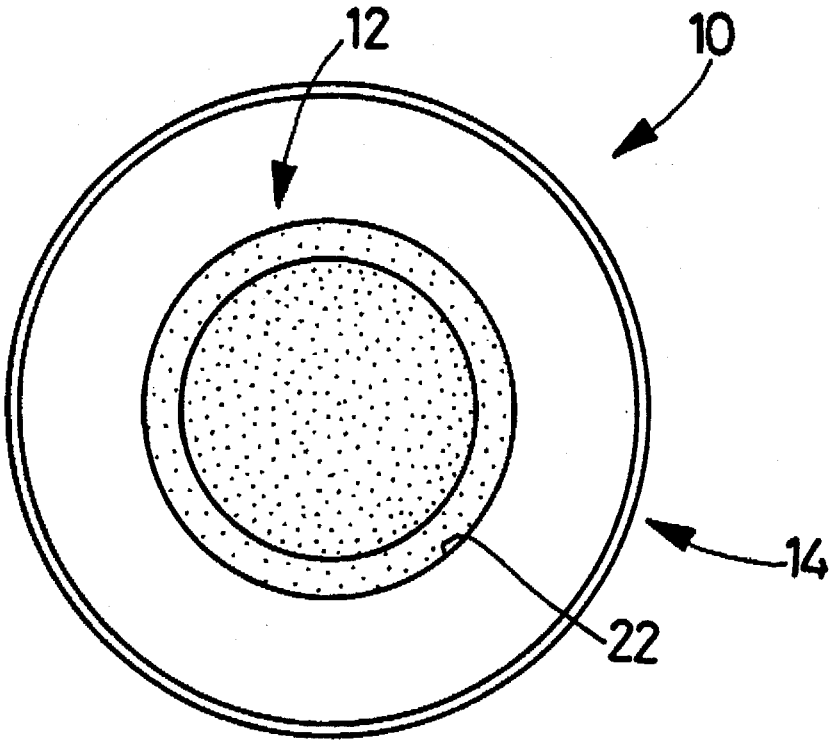
FIG. 3 is a bottom plan view of the jig shown in FIG. 1.

Referring to FIGS. 1–3, there will be described in detail one embodiment of a jig of the present invention, which is adapted to be bonded to a contact lens material. Like a conventional jig for the contact lens material, the jig generally indicated at 10 is an integrally formed body which consists of a protruding portion 12 and a base portion 14.

The protruding portion 12 of the jig 10 is formed of an achromatic transparent synthetic resin, such as acrylic resin. This protruding portion 12 assumes the shape of a circular truncated cone as a whole, and has a part-spherical convex surface 16 formed at a top or projecting end of the portion 12. This convex surface 16 generally conforms to an inner concave surface of a contact lens to be produced. In FIG. 1, a two-dot chain line indicates a contact lens blank or material 18 which has opposite surfaces, one of which is formed to be concave to provide the inner lens surface. This contact lens material 18 is bonded at its inner concave surface to the part-spherical convex surface 16 of the jig 10 when the other surface of the lens material 18 is machined or otherwise processed.

The base portion 14 of the jig 10 is made of the same material as the protruding portion 12. This base portion 14 takes the form of a generally thick-walled flange which extends radially outwards from the lower end part of the protruding portion 12, over the entire circumference thereof.

The jig 10 has a recess 22 which is formed on the rear side of the protruding portion 12, such that the recess 22 extends from the rear surface opposite to the part-spherical convex surface 16 of the top end of the protruding portion 12 toward the base portion 14, so as to be open on the lower end face or bottom surface of the jig 10. The recess 22 has a diameter which is smaller by a suitable value than the outside diameter of the protruding portion 12, and is defined by an inner wall whose shape substantially follows the outer profile of the protruding portion 12. With the recess 22 thus formed, the protruding portion 12 is provided with a relatively small, generally constant wall thickness.

The inner wall of the recess 22 has a first rear surface portion 24 which is opposite to the outer part-spherical convex surface 16 of the protruding portion 12, and a second rear surface portion 26 which is opposite to a generally cylindrical surface of the protruding portion 12 which extends from the lower end of the convex surface 16 to the upper end of the base portion 14. The first and second rear surface portions 24, 26 are roughened over their entire areas, like a surface of a file, sandpaper, grindstone or ground glass, with a light-scattering texture or pattern. For instance, the light-scattering texture consists of a network of minute indents, dimples, crimps or random height variations, as most clearly shown in FIG. 3. The light-scattering texture is finer in the first rear surface portion 24 than in the second rear surface portion 26. Namely, the first rear surface portion 24 has a finer network or density of such minute indents, dimples, crimps or random height variations than the second rear surface portion 26, so that the first rear surface portion 24 opposite to the part-spherical convex surface 16 effectively functions, like a ground glass, to promote the scattering or irregular reflection of light incident upon the portion 24. The surfaces 24, 26 may be roughened or roughly textured by a suitable method. For instance, a metal mold used for forming the jig 10 by injection molding is similarly roughened by etching, at a surface which forms the recess 22 of the protruding portion 12.

The jig 10 constructed as described above is held in position in use such that the part-spherical convex surface 16 of the protruding portion 12 is bonded by a suitable ultraviolet-curable (UV-curable) bonding agent or adhesive to the above-indicated one surface of the contact lens material formed as the inner lens surface. At the same time, the jig 10 is attached at the outer circumferential surface of the base portion 14 to a spindle (not shown). In this manner, the contact lens material 18 is fixed to the spindle through the jig 10, which permits the material 18 to be subjected to cutting and grinding operations and other treatments on the other surface as desired.

In the instant embodiment, in particular, the recess 22 is formed behind the protruding portion 12 bonded to the contact lens material 18, and the light-scattering minute indents or random height variations are formed with high density in the first rear surface portion 24 opposite to the convex surface 16 of the top end of the protruding portion 12. Thus, the first rear surface portion 24, which functions like a ground glass, has improved capability of scattering a light (ultraviolet radiation) incident thereupon. When the rear surface of the protruding portion 12 is irradiated with an ultraviolet radiation, so that the ultraviolet-curable bonding agent is cured by the ultraviolet radiation, the intensity of the ultraviolet radiation incident upon the UV-curable adhesive is substantially constant over the entire area of the part-spherical convex surface 16 of the protruding portion 12 which serves as the bonding surface. Thus, the contact lens material 18 can be bonded with substantial uniformity to the entire area of the bonding surface of the jig 10. This effectively eliminates a variation of the bonding strength of the contact lens material 18 to the jig 10 due to a variation of the intensity of the ultraviolet radiation incident upon the UV-curable adhesive. Consequently, the lens material 18 is protected against distortion or removal from the bonding surface during the cutting operation, which would otherwise be caused by the variation of the bonding strength, whereby the contact lens material 18 can be machined with an effectively improved accuracy.

In the above-described jig 10 in which the entire area of the inner surface (rear surface portion 24) opposite to the part-spherical convex surface 16 of the protruding portion 12 is given a significantly enhanced light-scattering capability, an incident light received from the outside through the contact lens material 18 can also be scattered at or irregularly reflected by the rear surface portion 24 of the protruding portion 12, resulting in an effectively reduced amount of light which is reflected by the protruding portion 12 back toward the contact lens material 18.

Accordingly, with the contact lens material 18 being bonded to the jig 10, a front curve of a contact lens to be produced can be measured with high accuracy, by irradiating the outer surface of the contact lens formed from the lens material, and detecting a light that is reflected by the outer lens surface. Thus, the contact lens material 18 is formed into a contact lens, which is then inspected in the same process while being bonded to the jig 10. This leads to an improved efficiency with which contact lenses are manufactured using the jig 10 constructed according to the present invention.

While the present invention has been described in its preferred embodiment, for illustrative purpose only, it is to be understood that the invention may be otherwise embodied.

In the illustrated embodiment, the shape of the recess 22 formed in the protruding portion 12 substantially conforms to the outer profile or contour of the protruding portion 12. However, the recess 22 may be otherwise shaped.

Further, the protruding portion 12 does not necessarily have a substantially constant wall thickness as in the illustrated embodiment in which the recess 22 is shaped as described above.

In the illustrated embodiment, the minute indents are formed in the first and second rear surface portions 24, 26 of the inner wall of the recess 22. However, the objects of the present invention may be achieved by forming the light-scattering texture or pattern in at least a portion of the inner wall of the recess which corresponds to the part-spherical convex surface of the protruding portion which is to be bonded to the contact lens material.

While the jig 10 is formed of acrylic resin in the illustrated embodiment, the material for forming a jig bonded to a contact lens material is not limited to that used in this embodiment, but may be suitably selected from polypropylene, polyethylene, polyester, polyacetal resin, polystyrene and others, as well as ABS resin. Since a contact lens formed may be removed from a jig bonded thereto by breaking the jig, the material for the jig needs to be appropriately selected from the above so that contact lenses are manufactured at a low cost with sufficiently high efficiency. It is desirable to form the jig by injection molding, using the above-indicated resin material.

While the present invention is applied to a jig used for a contact lens material or blank which gives a contact lens having a part-spherical lens surface in the illustrated embodiment, the invention is also advantageously applicable to a jig for a contact lens material which gives a contact lens having a non-spherical lens surface.

It is also to be understood that the present invention may be embodied with various other changes, modifications, and improvements which may occur to those skilled in the art, without departing from the scope of the invention as defined in the following claims.

What is claimed is:

1. A method of holding a contact lens material having a concave surface while the contact lens material is processed into a contact lens, comprising the steps of:

preparing a Jig including a protruding portion which has a top end having as an outer surface thereof a convex surface and a bottom end, said convex surface being adapted to be bonded to said concave surface of the contact lens material, said protruding portion having an inner surface that defines a recess which extends from said top end opposite said convex surface, toward the bottom end of the protruding portion, said inner surface including a first portion that corresponds to said convex surface of said top end of said protruding portion;

applying an ultraviolet-curable bonding agent to at least one of said concave surface of said contact lens material and said convex surface of said protruding portion of said Jig;

placing said contact lens material such that said concave surface of said contact lens material is in contact with said convex surface of said jig through said ultraviolet-curable bonding agent; and irradiating said ultraviolet-curable bonding agent through said jig via means for scattering light to cure said ultraviolet-curable bonding agent and thereby bond said contact lens material and said jig together, said means for scattering light comprising a roughed light-scattering texture along said first portion of said inner surface.

2. A method as defined in claim 1, wherein said step of preparing a jig comprises roughly texturing said first portion of said inner surface of said recess with a network of minute indents.

3. A method as defined in claim 1, wherein said step of preparing a jig comprises forming said protruding portion of a transparent synthetic resin.

* * * * *